US006084511A

United States Patent [19]

Kil

[11] Patent Number: 6,084,511

[45] Date of Patent: Jul. 4, 2000

[54] NOTIFICATION DEVICE FOR CONTAINERS WITH OPENINGS

[76] Inventor: Joon K. Kil, Yangju-Gun, Joonae-Myun, Sanbook 38, Kyungki-do, Rep. of Korea

[21] Appl. No.: 09/420,815

[22] Filed: Oct. 10, 1999

[51] Int. Cl.[7] ..... G08B 13/14

[52] U.S. Cl. ..... 340/570; 340/545.6; 340/545.9; 340/550; 340/570

[58] Field of Search ..... 340/546, 570, 340/545.6, 545.9, 550, 692, 691.5

[56] References Cited

U.S. PATENT DOCUMENTS

| | | | |
|---|---|---|---|
| 527,589 | 10/1894 | Bristol . | |
| 884,843 | 4/1908 | Newman . | |
| 2,955,282 | 10/1960 | Boyle et al. | 340/274 |
| 3,541,276 | 11/1970 | Lea | 200/61.62 |
| 3,631,445 | 12/1971 | Shew | 340/274 |
| 3,855,432 | 12/1974 | Kelly et al. | 200/61.61 |
| 4,965,551 | 10/1990 | Box | 340/547 |
| 5,120,118 | 6/1992 | Rankin | 312/409 |
| 5,504,325 | 4/1996 | Talmon et al. | 340/555 |
| 5,568,123 | 10/1996 | Derheim | 340/545 |

*Primary Examiner*—Jeffery A. Hofsass
*Assistant Examiner*—Hung Nguyen
*Attorney, Agent, or Firm*—John K. Park; Park & Sutton LLP

[57] ABSTRACT

A notification device for use with a plurality of barriers corresponding to a plurality of openings in a container having an interior space accessible through said openings. Each barrier having a closed position in which it closes a corresponding opening and an open position to provide access to said interior space. The notification device providing a notification signal when one or more of said barriers has been moved from the closed position toward said open position. The notification device comprises: a power supply; a sensor mounted adjacent each barrier and corresponding opening for sensing when that barrier is not in a closed position; and a signal generator having multiple signal generation modes for generating a unique notification signal in each mode in response to each sensor. Each sensor for a corresponding barrier: (1) electrically connects the signal generator to the power supply when that barrier is not in the closed position, and (2) electrically disconnects the signal generator from the power supply when the barrier is in the closed position. As such, when electrically connected to the power supply, the signal generator generates a unique notification signal for each barrier not in a closed position.

7 Claims, 5 Drawing Sheets

NOTIFICATION DEVICE FOR CONTAINERS WITH OPENINGS

FIELD OF THE INVENTION

The present invention relates generally to notification devices for containers.

BACKGROUND OF THE INVENTION

Containers having openings protected by doors, such as drawers and closets, are used for storing objects including valuable objects. A user gains access to the container through an opening by opening the door. After placing an object in the container, the user then uses the door to close the opening. However, in many instances, a user may neglect to close the container door properly. As such, there is a need for a notification device to notify the user if the container door is not closed properly. In other instances, after the user closes the door properly, the user desires notification if another user opens the door to the container. Further, for container with multiple openings and doors, the user desires notification of which door has been opened.

BRIEF SUMMARY OF THE INVENTION

The present invention provides a notification device that satisfies these needs. In one embodiment, the present invention provides a notification device for use with a plurality of barriers corresponding to a plurality of openings in a container having an interior space accessible through said openings. Each barrier having a closed position in which it closes a corresponding opening and an open position to provide access to said interior space. The notification device providing a notification signal when one or more of said barriers has been moved from the closed position toward said open position. The notification device comprises: a power supply; a sensor mounted adjacent each barrier and corresponding opening for sensing when that barrier is not in a closed position; and a signal generator having multiple signal generation modes for generating a unique notification signal in each mode in response to each sensor. Each sensor for a corresponding barrier: (1) electrically connects the signal generator to the power supply when that barrier is not in the closed position, and (2) electrically disconnects the signal generator from the power supply when the barrier is in the closed position. As such, when electrically connected to the power supply, the signal generator generates a unique notification signal for each barrier not in a closed position.

The notification device can further comprise a switch means for each barrier, each switch means being responsive to the sensor for a corresponding barrier for: (1) electrically connecting the signal generator to the power supply when that barrier is not in the closed position, and (2) electrically disconnecting the signal generator from the power supply when the barrier is in the closed position.

In another embodiment, at least one of the sensors comprises a switch means mounted proximate said opening, the switch means having: (i) an open position whereby the signal generator is electrically disconnected from the power supply, and (ii) a closed position whereby the signal generator is electrically connected to the power supply. The sensor further comprises, an actuator mounted to the barrier, wherein: (i) when the barrier is in the closed position the actuator places the switch means into the open position to electrically disconnect the signal generator from the power supply, and (ii) when the barrier is not in the closed position the actuator places the switch means into the closed position to electrically connect the signal generator to the power supply.

BRIEF DESCRIPTION OF THE DRAWINGS

These and other features, aspects, and advantages of the present invention will become better understood with regard to the following description, appended claims, and accompanying drawings which illustrate examples of the invention, where:

DETAILED DESCRIPTION OF THE INVENTION

Figure 1:
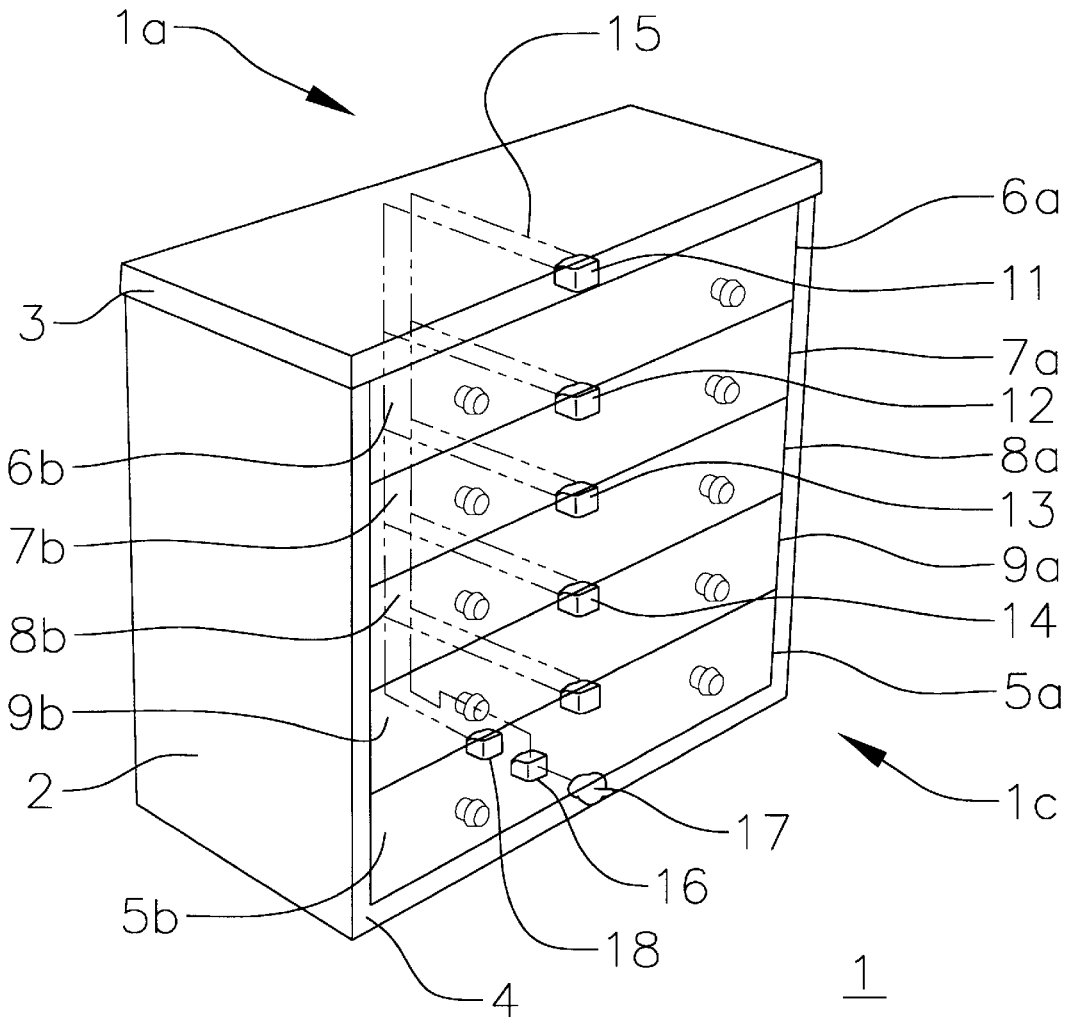
FIG. 1 shows a perspective view of a container including an embodiment of a notification device according to the present invention.
Figure 2:
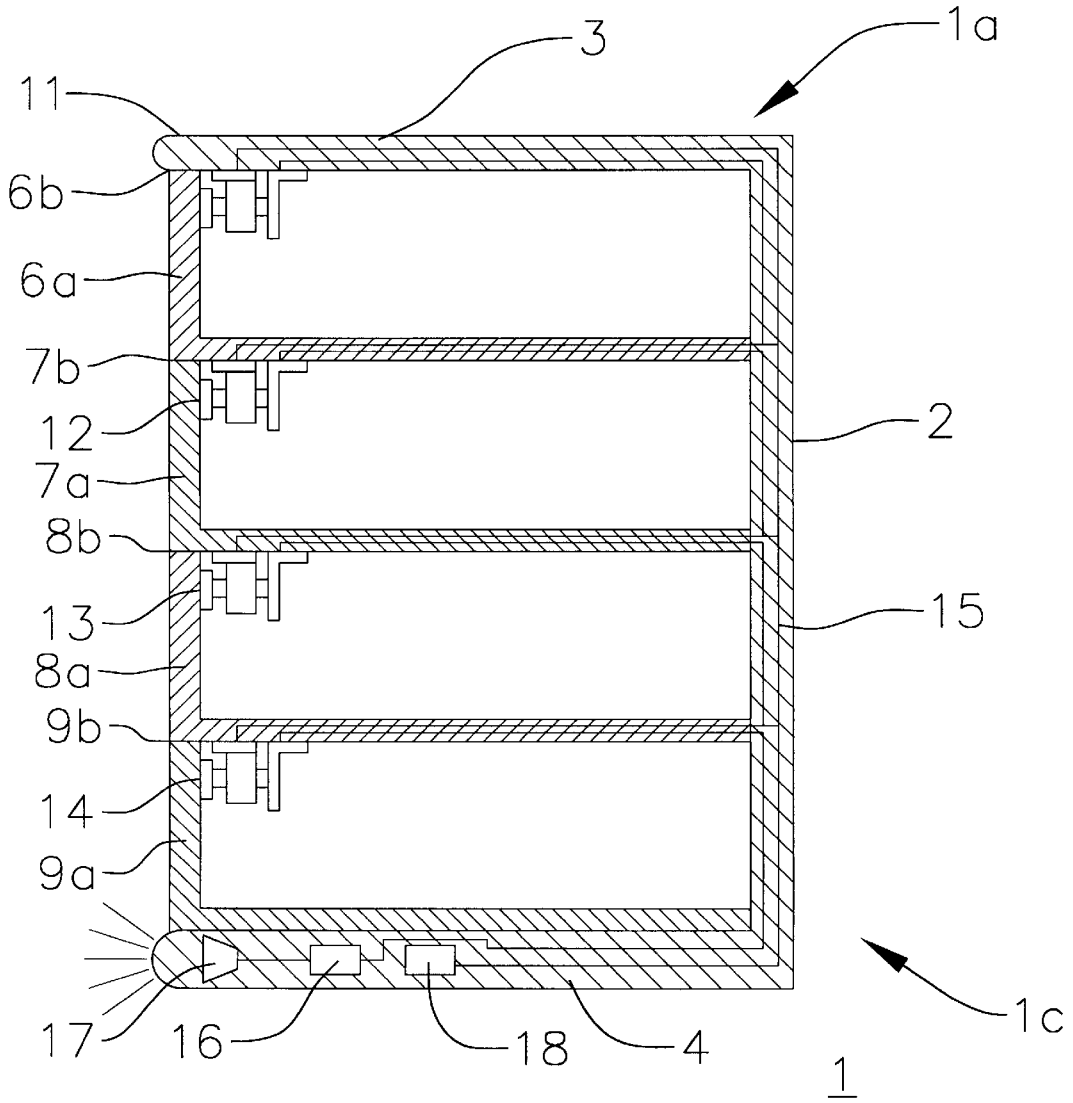
FIG. 2 shows a side section view of another container including said notification device.

FIGS. 1–2 show example containers such as a chest of drawers or bureau 1 comprising a shell 1*a* including sidewalls 2, top 3 and bottom 4, and multiple openings 5*a*–9*a* for receiving corresponding drawers 5*b*–9*b*. Each drawer e.g. 6*b* has a closed position (e.g., FIG. 3) in which it closes a corresponding opening e.g. 6*a,* and an open position (e.g., FIG. 4) to provide access to the interior of the shell 1*a*. The container 1 includes an embodiment of a notification device 1*c* according to the present invention to provide a signal when one or more of the drawers 5*b*–9*b* has been moved from the closed position toward the open position.

Referring to FIGS. 1–2, the notification device 1*c* comprises a power supply 18; sensors 10–14 mounted adjacent corresponding drawers 5*b*–9*b* and corresponding openings 5*a*–9*a* for sensing when each of the respective drawers 5*b*–9*b* is not in a closed position; and a signal generator 16 having multiple signal generation modes for generating a unique notification signal in each mode in response to each of the sensors 10–14. Each of the sensors 10–14 for each of the corresponding drawers 5*b*–9*b:* (1) electrically connects the signal generator 16 to the power supply 18 when that drawer is not in the closed position, and (2) electrically disconnects the signal generator 16 from the power supply 18 when the drawer is in the closed position, such that, when electrically connected to the power supply 18, the signal generator 16 generates a unique notification signal for each of the drawers 5*b*–9*b* not in a closed position.

Figure 3:
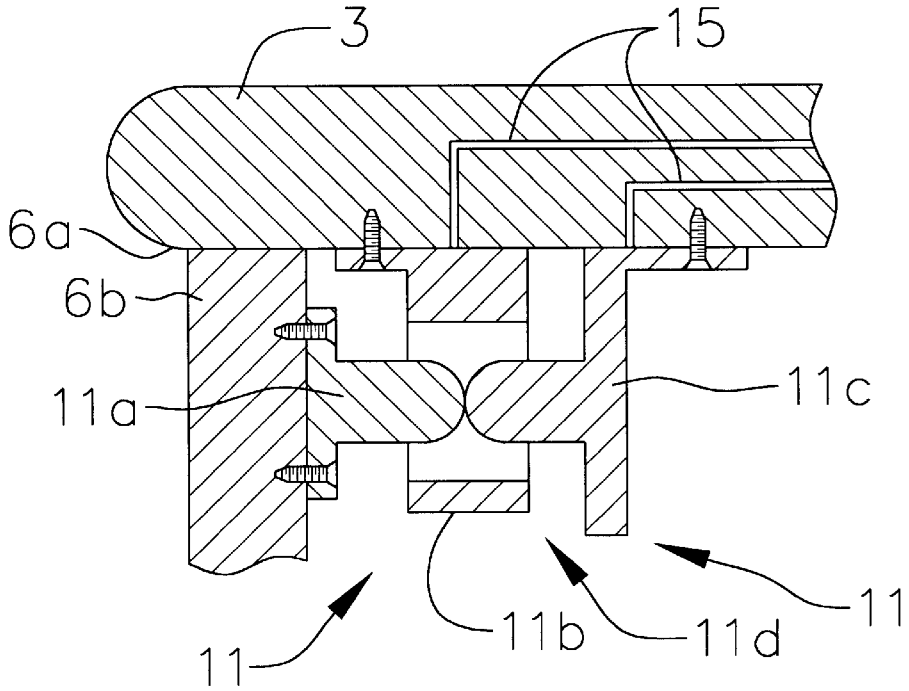
FIG. 3 shows a side view of an embodiment of a sensor for sensing the open/close position of a drawer of the container of FIG. 2, wherein the container drawer is in the closed position.
Figure 4:
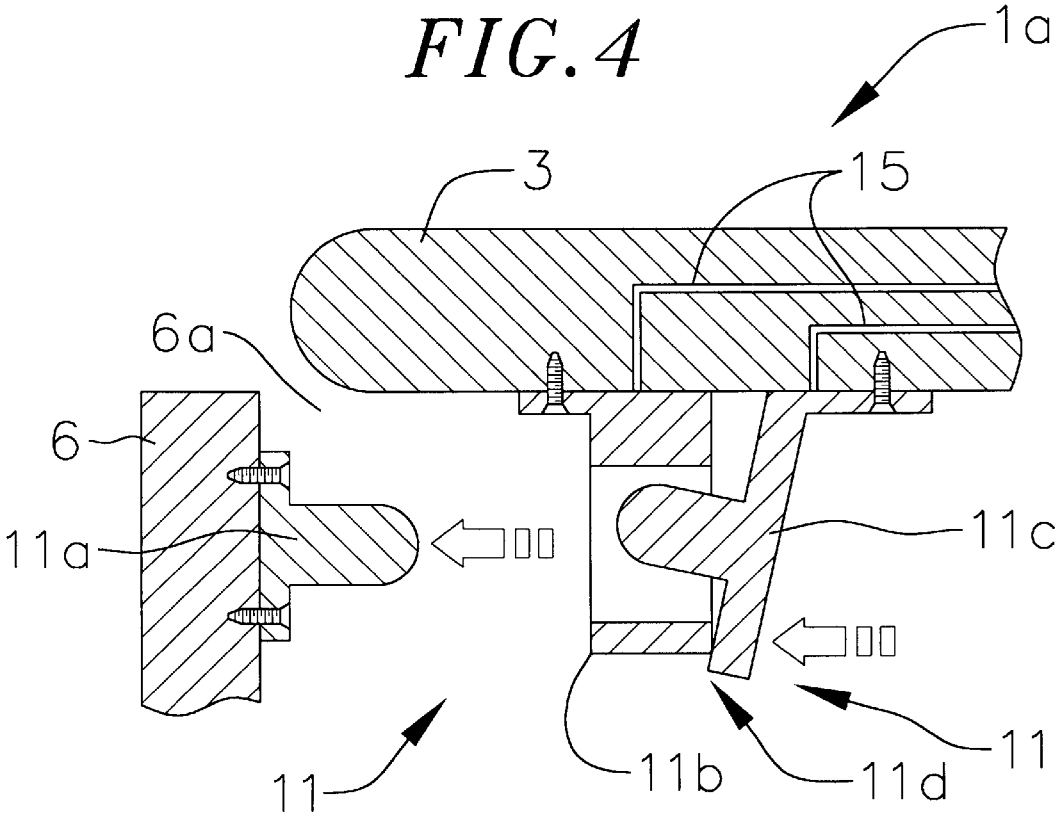
FIG. 4 shows another side view of the sensor of FIG. 3 when the container drawer is in not in the closed position.

Referring to FIGS. 3–4, at least one of the sensors e.g. 11 comprises a switch means 11*d* mounted proximate a corresponding opening 6*a,* wherein the switch means 11*d* has: (i) an open position (FIG. 3) whereby the signal generator 16 is electrically disconnected from the power supply 18, and (ii) a closed position (FIG. 4) whereby the signal generator 16 is electrically connected to the power supply 18. The switch means 11*d* comprises a fixed metal contact 11*b* connected to the power supply 18 via wire 15, and a pivoting metal contact 11*c* connected to the signal generator 16 via wire 15.

The sensor 11 further comprises an actuator 11*a* mounted to the drawer 6*b,* wherein: (i) when the drawer 6*b* is in the closed position (FIG. 3) the actuator 11*a* urges the contact 11*c* away from the contact 11*b,* thereby placing the switch means 11*d* into the open position to electrically disconnect the signal generator 16 from the power supply 18, and (ii) when the drawer 6*b* is not in the closed position (FIG. 4) the actuator 11*c* allows the contact 11*c* to rotate into electrical contact with the contact 11*b,* thereby places the switch means 11*d* into the closed position to electrically connect the signal generator 16 to the power supply 18. The contact 11*c* can be spring loaded to rotate into contact with the contact 11*b* unless urged away from contact with the contact 11*b* by the actuator 11*a*. Other sensors can have the same structure as the sensor 11. As shown in FIGS. 1–2, the sensors form a parallel system, such that if any one of the drawers 5*b*–9*b* is closed, the signal generator 16 is electrically connected to the power supply 18.

Figure 5:
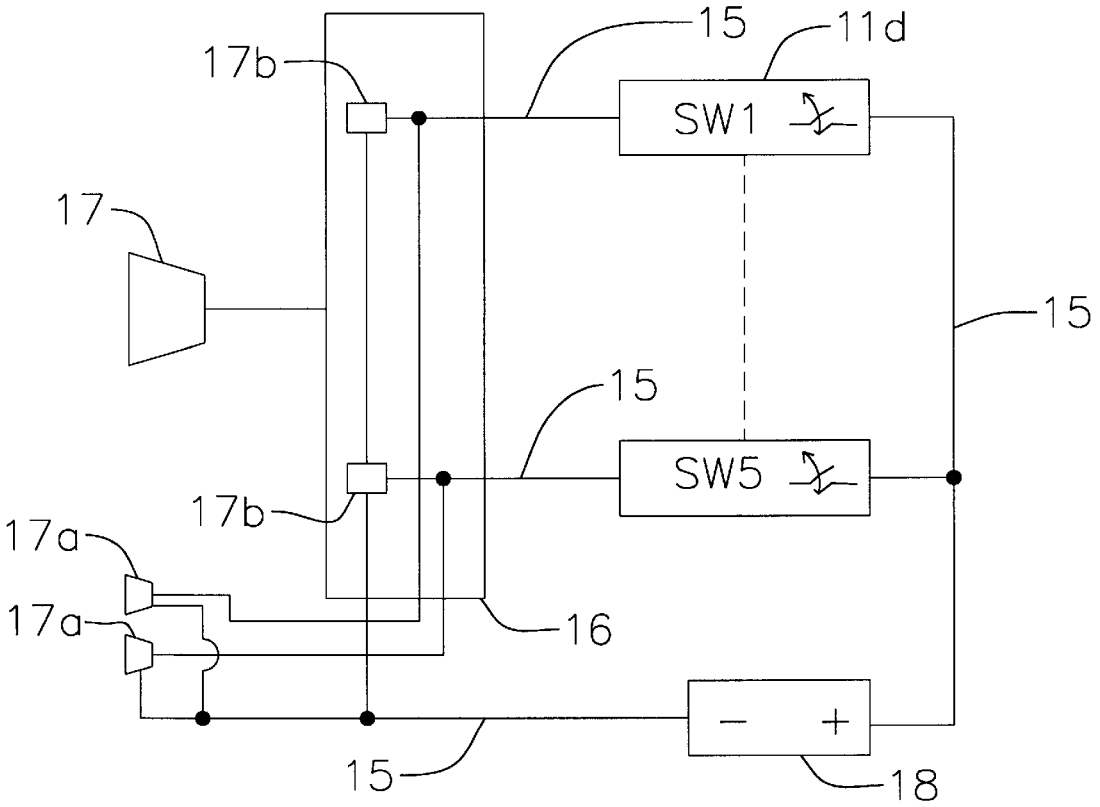
FIG. 5 shows a block diagram of an embodiment of a signal generator for the notification device of FIGS. 1 and 3.

Referring to FIG. 5, the signal generator 16 can include sound generation means such as a speaker 17 for generating audio signals when connected to the power supply 18. The generator 16 can also include light generation means such as bulbs 17*a* for generating light when connected to the power supply 18. The signal generator can also comprise an alarm system. The switch means in the sensors 10–14 are shown as switches SW1–SW5, respectively. The signal generator generates a unique notification signal when connected to the power supply 18 via each of the switches SW1–SW5. As such, a user can determine which drawer is not in a closed position.

For example, the signal generator 16 can include multiple tone generators 17*b* with different tones, each tone generator 17*b* connected to one of the corresponding switches SW1–SW5, such that when one of the switches SW1–SW5 is closed, the corresponding tone generator in the signal generator 16 is electrically connected to the power supply 18 to drive the speaker 17 to generate a unique tone. The user can identify which drawer is open by the unique tone associated with that drawer. If two or more of the switches SW1–SW5 are closed, the speaker 17 can generate multiple tones at the same time. Similarly, the bulbs 17*a* can be different colors and each connected to a corresponding switch among SW1–SW5 to be turned on when a corresponding switch SW1–SW5 is closed to electrically connect the bulb 17*a* to the power supply 18. The user can identify the open drawer or drawers by the color of one or more of the bulbs 17*a* being turned on.

In another example embodiment, the signal generator 16 can include multiple sound or speech generators 17*b* with different sounds or speeches, each generator 17*b* connected to one of the corresponding switches SW1–SW5, such that when one of the switches SW1–SW5 is closed, the corresponding generator 17*b* in the signal generator 16 is electrically connected to the power supply 18 to drive the speaker 17 to generate a unique tone. The user can identify which drawer is open by the unique sound or speech associated with that drawer. If two or more of the switches SW1–SW5 are closed, the speaker 17 can generate multiple sounds or speeches at the same time. For example, each generator 17*b* can comprise a integrated circuit with a specific speech pattern stored therein such as e.g. "Hello John, here are your shirts" for one drawer, and "Hi Susan, here are your skirts" for another drawer etc. The speech can include tones such as music. The integrated circuit includes specialized digital circuits for storing said prerecorded sounds or speech patterns as is known in the art.

Figure 6:
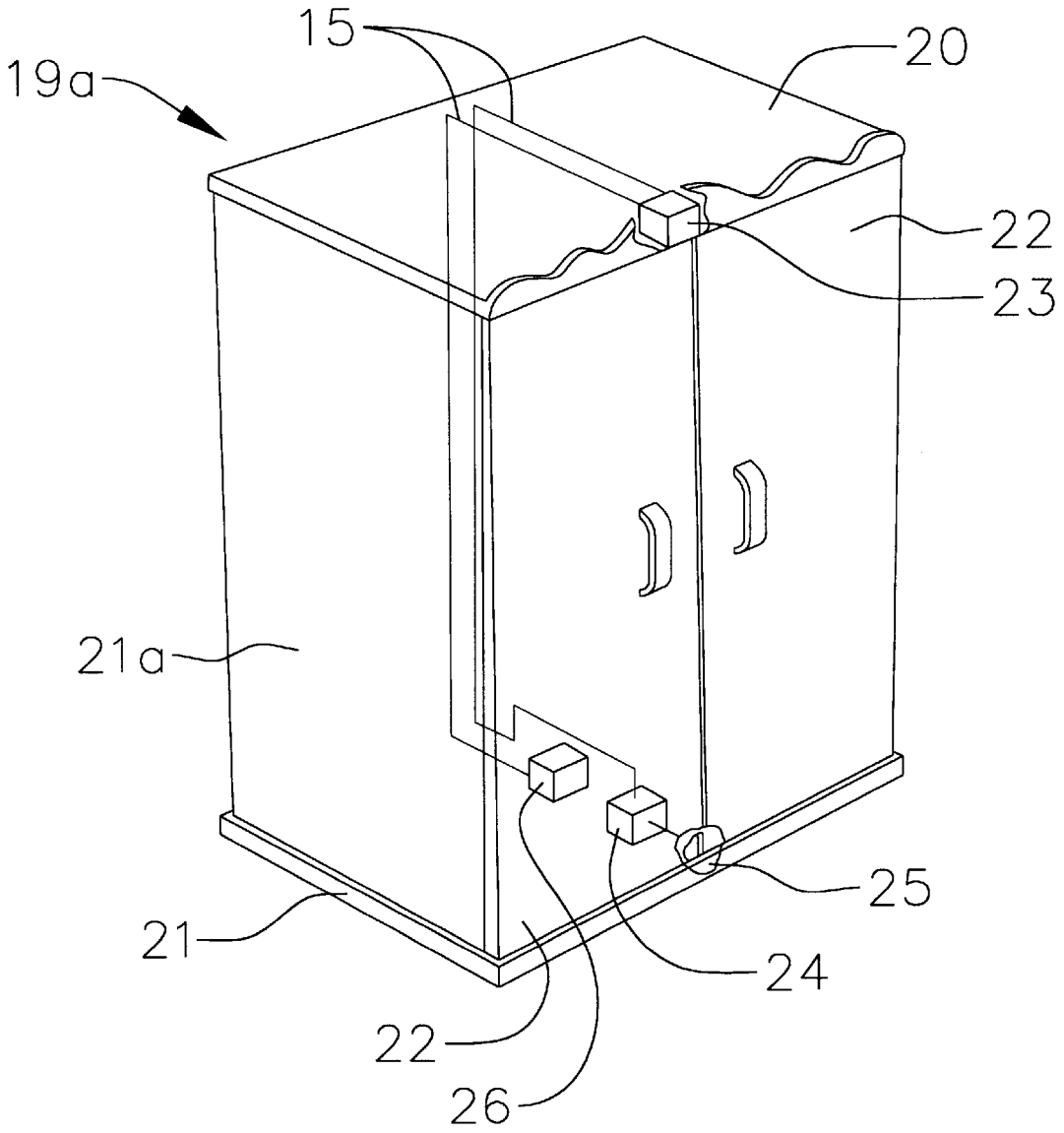
FIG. 6 shows a perspective view of another container including another embodiment of a notification device according to the present invention.

FIG. 6 shows another container such a cupboard 19 having a shell 19*a* with sidewalls 19*a,* top 20 and bottom 21, and including doors 22 hingedly attached to the sidewalls 21*a*. A sensor 23 sensor the open/closed position of one or both doors 22 and electrically connects a signal generator 24 to a power supply 26 to drive the sound generator 25, when one or both doors 22 are open. The sensor 23 can be the same as sensor 11 described above. Further, the signal generator 34 and the speaker 25 can be as described above. A notification device according to the present invention can be used with other containers such as wardrobes, filing cabinets, safes, storage boxes, etc.

Although the present invention has been described in considerable detail with regard to the preferred versions thereof, other versions are possible. Therefore, the appended claims should not be limited to the descriptions of the preferred versions contained herein.

What is claimed is:

1. A notification device for use with a plurality of barriers corresponding to a plurality of openings in a container having an interior space accessible through said openings, each barrier having a closed position in which it closes a corresponding opening and an open position to provide access to said interior space, the notification device providing a signal when one or more of said barriers has been moved from the closed position toward said open position, the notification device comprising:

(a) a power supply;

(b) a sensor mounted adjacent each barrier and corresponding opening for sensing when that barrier is not in a closed position; and (c) a signal generator having multiple signal generation modes for generating a unique notification signal in each mode in response to each sensor; and wherein each sensor for a corresponding barrier: (1) electrically connects the signal generator to the power supply when that barrier is not in the closed position, and (2) electrically disconnects the signal generator from the power supply when the barrier is in the closed position;

such that, when electrically connected to the power supply, the signal generator generates a unique notification signal for each barrier not in a closed position.

2. The notification device of claim 1, further comprising a switch means for each barrier, each switch means being responsive to the sensor for a corresponding barrier for: (1) electrically connecting the signal generator to the power supply when that barrier is not in the closed position, and (2) electrically disconnecting the signal generator from the power supply when the barrier is in the closed position.

3. The notification device of claim 1, wherein the signal generator comprises an alarm system.

4. The notification device of claim 1, wherein the signal generator includes sound generation means for generating audible notification signals.

5. The notification device of claim 1, wherein the signal generator includes light generation means for generating visual notification signals.

6. The notification device of claim 1, wherein the signal generator includes means for generating radio frequency notification signals.

7. The notification device of claim 1, wherein at least one of the sensors comprises:

a switch means mounted proximate said opening, the switch means having: (i) an open position whereby the signal generator is electrically disconnected from the power supply, and (ii) a closed position whereby the signal generator is electrically connected to the power supply; and an actuator mounted to the barrier, wherein: (i) when the barrier is in the closed position the actuator places the switch means into the open position to electrically disconnect the signal generator from the power supply, and (ii) when the barrier is not in the closed position the actuator places the switch means into the closed position to electrically connect the signal generator to the power supply.

* * * * *